US011534652B1

(12) United States Patent
Sanchez

(10) Patent No.: US 11,534,652 B1
(45) Date of Patent: Dec. 27, 2022

(54) HANDHELD EXERCISE DEVICE AND METHOD FOR PERSONAL FITNESS TRAINING

(71) Applicant: Austin Sanchez, Warrenton, VA (US)

(72) Inventor: Austin Sanchez, Warrenton, VA (US)

( * ) Notice: Subject to any disclaimer, the term of this patent is extended or adjusted under 35 U.S.C. 154(b) by 0 days.

(21) Appl. No.: 17/140,463

(22) Filed: Jan. 4, 2021

(51) Int. Cl.

| | |
|---|---|
| ***A63B 21/00*** | (2006.01) |
| ***A63B 22/20*** | (2006.01) |
| ***A63B 23/12*** | (2006.01) |
| *A63B 23/035* | (2006.01) |

(52) U.S. Cl.
CPC ..... *A63B 21/4035* (2015.10); *A63B 21/4049* (2015.10); *A63B 22/20* (2013.01); *A63B 23/1236* (2013.01); *A63B 21/4019* (2015.10); *A63B 23/03508* (2013.01); *A63B 2208/0257* (2013.01)

(58) Field of Classification Search
CPC . A63B 21/4035; A63B 21/4049; A63B 22/20; A63B 23/1236; A63B 21/4019; A63B 23/03508; A63B 2208/0257
See application file for complete search history.

(56) References Cited

U.S. PATENT DOCUMENTS 3,809,393 A * 5/1974 Jones ..... A63B 22/20 482/132
4,134,584 A 1/1979 Rosenbusch
4,892,305 A * 1/1990 Lynch ..... A63B 22/20 482/146
D346,660 S * 5/1994 Chiang ..... D24/215
5,632,707 A * 5/1997 Daniel ..... A63B 22/20 482/141
D479,289 S * 9/2003 Turner ..... D21/662
6,773,379 B1 * 8/2004 Bing ..... A63B 22/20 482/907
6,942,605 B1 * 9/2005 Sukhovitsky ..... A63B 21/4017 2/24
7,468,025 B2 12/2008 Hauser et al.
D585,947 S * 2/2009 Royster ..... D21/662
7,621,858 B2 11/2009 Sheron
7,935,039 B2 * 5/2011 Dannenberg ..... A63B 23/12 482/141
7,935,040 B2 5/2011 Moskowich
7,951,055 B2 5/2011 Mulderrig et al.
7,981,016 B1 * 7/2011 Howard ..... A63B 21/4019 482/141
D653,714 S * 2/2012 Meininger ..... D21/662
D654,544 S * 2/2012 Sliemers ..... D21/679
D654,545 S * 2/2012 Richard ..... D21/662
8,353,808 B1 * 1/2013 Barney ..... A63B 23/0355 482/141
8,827,879 B2 * 9/2014 Nicholas ..... A63B 23/0355 482/141

(Continued)

*Primary Examiner* — Andrew S Lo
(74) *Attorney, Agent, or Firm* — Schwartz Law Firm, P.C.

(57) ABSTRACT

A handheld exercise device includes an elongated handle and first and second stability heads. The stability heads are located at opposite ends of the handle, and each has a generally dome-shaped top side and generally planar underside. An arrangement of surface-engaging rollers projects from the planar underside of each stability head. The roller arrangement includes first and second inline rollers substantially aligned with a longitudinal axis of the handle, and a third roller laterally offset from the longitudinal axis of the handle.

19 Claims, 7 Drawing Sheets

(56) References Cited

U.S. PATENT DOCUMENTS

D739,900 S * 9/2015 Smith ..... D21/662
9,440,110 B2 9/2016 Izzo et al.
9,533,183 B1 * 1/2017 Khalil ..... A63B 21/0004
9,833,659 B1 * 12/2017 Nicholas ..... A63B 22/20
9,993,685 B2 * 6/2018 Stevens ..... A63B 23/1236
10,272,288 B2 * 4/2019 Brown ..... A63B 23/1236
D870,908 S * 12/2019 Hyder ..... A61H 15/00 D24/211
2004/0266593 A1 12/2004 Schwendeman
2005/0209072 A1 * 9/2005 Sheron ..... A63B 21/0618 482/92
2006/0014615 A1 * 1/2006 Godbold ..... A63B 21/4035 482/141
2008/0305935 A1 * 12/2008 Sanghavi ..... A63B 21/4035 482/91
2010/0004105 A1 * 1/2010 Peddar ..... A63B 22/20 482/132
2010/0130337 A1 * 5/2010 Stewart ..... A63B 23/12 482/141
2010/0317496 A1 * 12/2010 Abranchess ..... A63B 23/12 482/141
2011/0160024 A1 * 6/2011 Candela ..... A63B 23/0211 482/132
2012/0238420 A1 * 9/2012 Meininger ..... A63B 21/4035 482/132
2013/0184131 A1 * 7/2013 Doyle ..... A63B 22/18 482/139
2013/0217549 A1 * 8/2013 Marji ..... A63B 21/4035 482/132
2014/0371040 A1 * 12/2014 Vasquez ..... A63B 21/0004 482/39
2016/0067541 A1 * 3/2016 Lopez ..... A63B 21/0552 482/124
2017/0189739 A1 * 7/2017 Ressler, III ..... A63B 21/00181
2018/0036588 A1 * 2/2018 Brown ..... A63B 23/03541
2018/0185702 A1 * 7/2018 Brown ..... A63B 23/0355
2019/0030395 A1 * 1/2019 Barney ..... A63B 23/0216

* cited by examiner

HANDHELD EXERCISE DEVICE AND METHOD FOR PERSONAL FITNESS TRAINING

TECHNICAL FIELD AND BACKGROUND OF THE DISCLOSURE

The present disclosure relates broadly and generally to a handheld exercise device and method for personal fitness training. In exemplary embodiments, the exercise device of the present disclosure is applicable for performing a wide variety of full-body floor exercises without needing to get up from the floor or reposition the body. Exemplary floor exercises include ab rollouts, push-ups (close, normal and wide stance), and chest flies. In a prone position and gripping the exercise devices—one in each hand—the user can perform a full-body extension and cycle through a wide range of upper and lower body stretches. In a seated or supine position, the exemplary exercise device may be located under one or both heels of the feet to perform abduction and adduction leg exercises and other such movements.

SUMMARY OF EXEMPLARY EMBODIMENTS

Various exemplary embodiments of the present disclosure are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises a handheld exercise device. The exercise device includes an elongated handle and first and second stability heads. The stability heads are located at opposite ends of the handle, and each has a generally dome-shaped top side and generally planar underside. An arrangement of surface-engaging rollers projects from the planar underside of each stability head. The roller arrangement includes first and second inline rollers substantially aligned with a longitudinal axis of the handle, and a third roller laterally offset from the longitudinal axis of the handle.

According to another exemplary embodiment, an ergonomic swivel grip is applied to the handle and adapted for being gripped by a user. Alternatively, the handle itself may swivel by rotational attachment to the two stability heads. The swivel handle may also be selectively locked in a fixed (non-rotating) condition.

According to another exemplary embodiment, at least one roller bearing is located between the swivel grip and handle.

According to another exemplary embodiment, the roller bearing comprises a needle roller bearing.

According to another exemplary embodiment, first and second spaced apart needle roller bearings are located between the swivel grip and handle.

According to another exemplary embodiment, the swivel grip is fabricated of synthetic rubber.

According to another exemplary embodiment, the synthetic rubber comprises neoprene.

According to another exemplary embodiment, the underside of each stability head is annular.

According to another exemplary embodiment, a diameter of the underside of each stability head is between 10-12 cm.

According to another exemplary embodiment, the first, second and third rollers are equally spaced apart from one another and reside at respective points of a notional (equilateral) triangle.

In another exemplary embodiment, the present disclosure comprises a handheld exercise device incorporating an elongated handle and first and second stability heads. The stability heads are located at opposite ends of the handle, and each stability head has a generally dome-shaped top side and generally planar underside. A roller arrangement of surface-engaging rollers projects from the planar underside of each stability head. A swivel grip is applied to the handle and is configured to rotate about an axis defined by the handle. When the exercise device is gripped by a user performing a floor exercise, the roller arrangement and swivel grip cooperate to create an enhanced imbalance designed to strengthen a core of the user. In exemplary embodiments, the swivel grip may be either separately or integrally formed with the handle. The term "floor exercise" refers broadly to any movement performed with the body (or part of the body) and/or exercise device located on the floor or other supporting surface.

BRIEF DESCRIPTION OF THE DRAWINGS

Exemplary embodiments of the present disclosure will hereinafter be described in conjunction with the following drawing figures, wherein like numerals denote like elements, and wherein.

DESCRIPTION OF EXEMPLARY EMBODIMENTS AND BEST MODE

Figure 1:
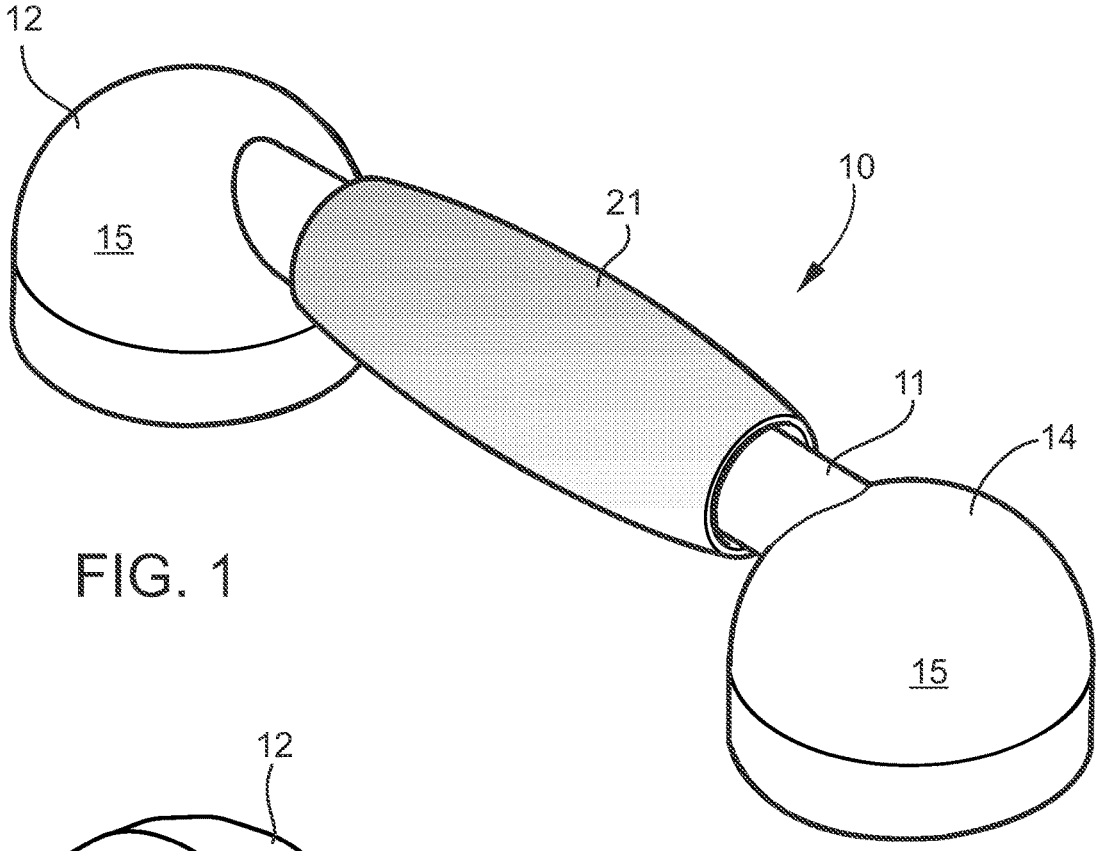
FIGS. 1 and 2 are perspective views of the present handheld exercise device according to one exemplary embodiment.
Figure 2:
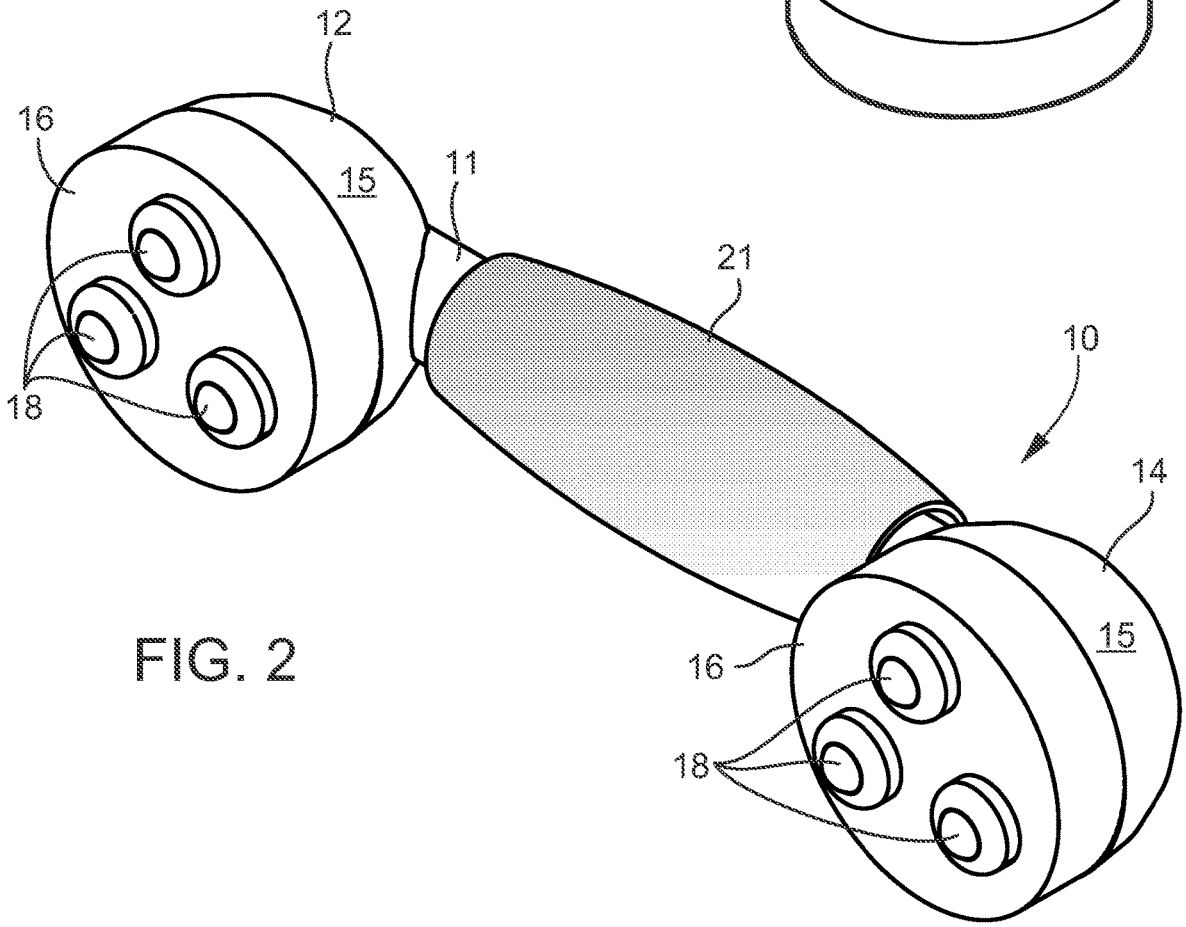
Figure 3:
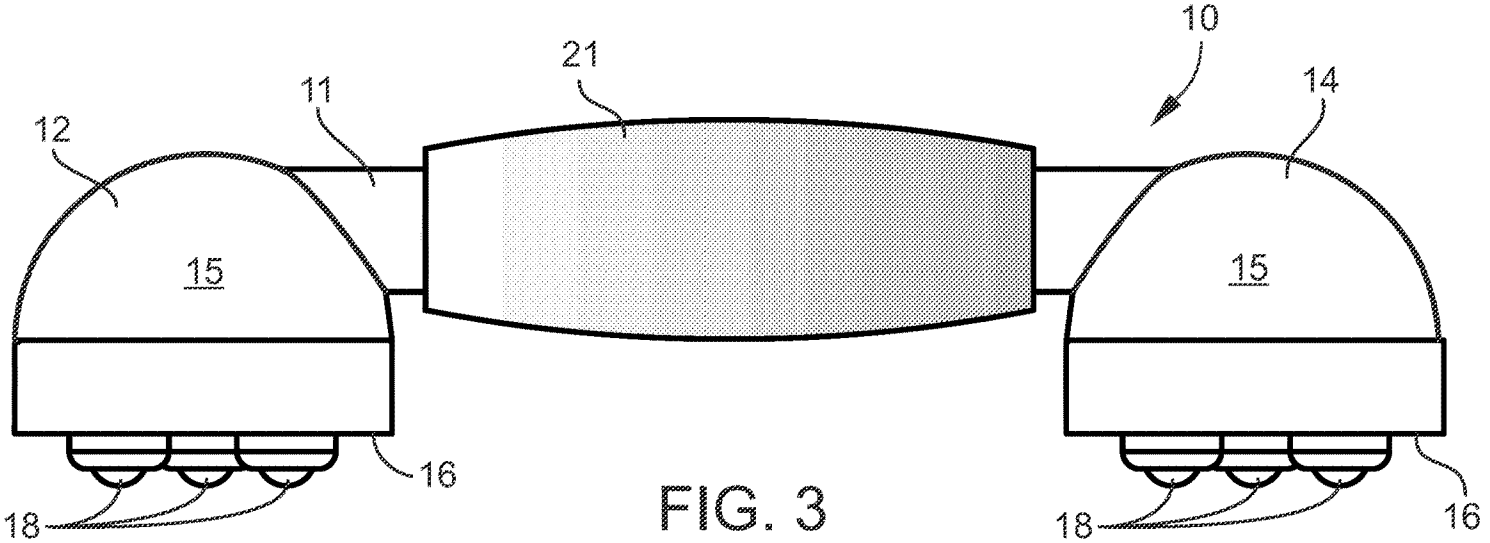
FIG. 3 is a side view of the exemplary exercise device.

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Referring now specifically to the drawings, a handheld exercise device according to one exemplary embodiment of the present disclosure is illustrated in FIGS. 1-4 and shown generally at broad reference numeral 10. The exemplary exercise device 10 resembles a conventional dumbbell, and incorporates a short elongated handle 11 and first and second weighted stability heads 12, 14. The exercise device 10 may be constructed in any number of overall weight sizes including 2.5 lbs, 5 lbs, 10 lbs and others. The stability heads 12, 14 are located at opposite ends of the handle 11, and each has a generally dome-shaped top 15 and generally planar underside 16. The dome-shaped top 15 of each stability head 12, 14 may be fabricated of a molded solid neoprene rubber or other such material. As described further below, an arrangement of surface-engaging rollers 18 projects from the planar underside 16 of each stability head 12, 14 and functions to enable the exercise device 10 to freely roll atop a floor or other flat surface.

Figure 5:
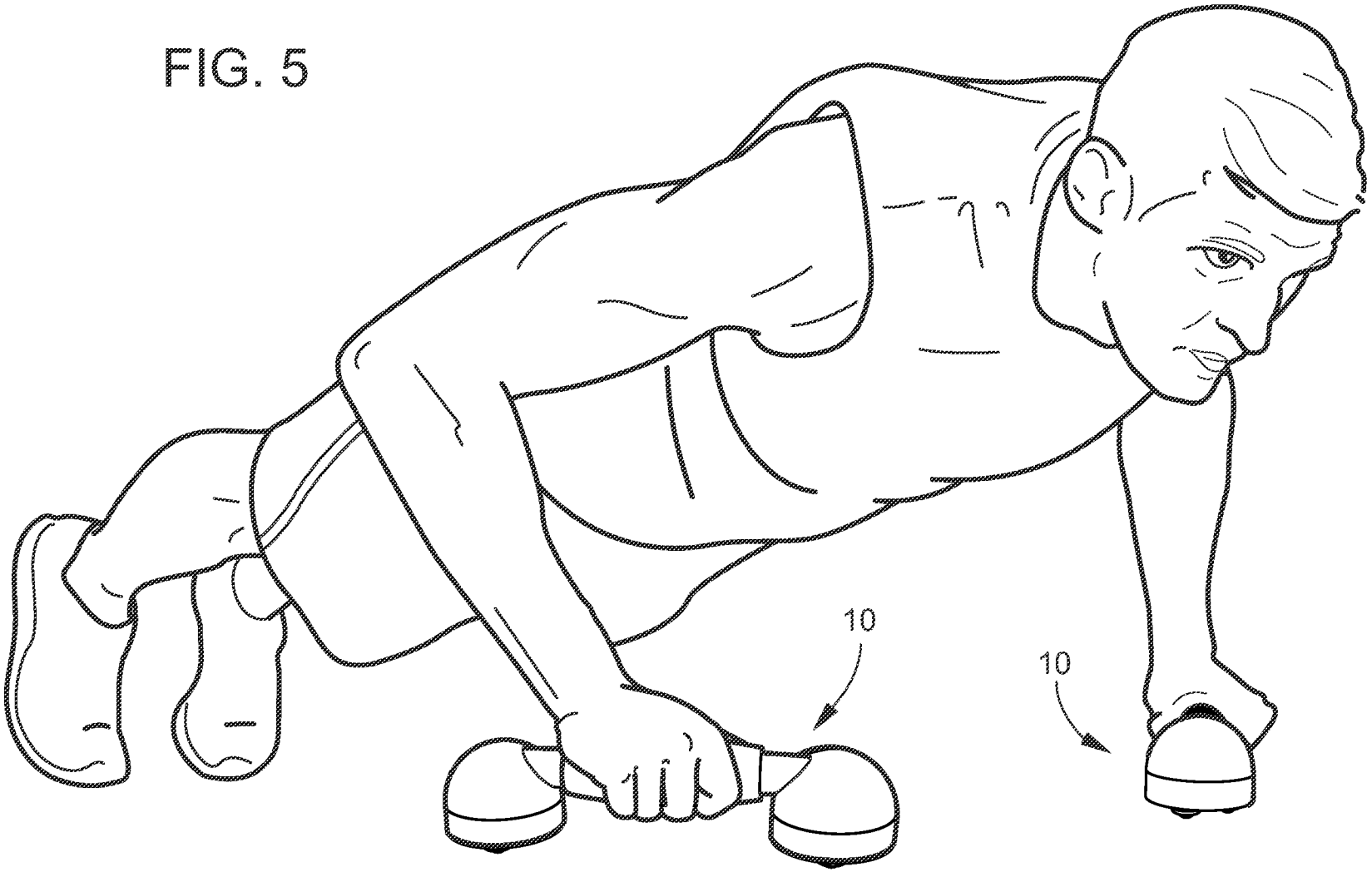
FIG. 5 is a view demonstrating use of the exemplary exercise device while performed a floor exercise.

An ergonomic rubber swivel grip 21 may be applied to the handle 11 and may extend substantially from one stability head 12 to the other head 14. The swivel grip 21 combines with the rollers 18 of each stability head 12, 14 to create substantial imbalance when the device 10 is held against the floor surface by an exercising user in a prone position—as demonstrated in FIG. 5. This imbalance functions to strengthen and tone the abdominal muscles, back and shoulders, while also stretching out the torso and improving flexibility. Users may exercise with a device 10 held in both hands, as shown in FIG. 5, or with the device 10 in a single hand, or with multiple devices 10 held in one or both hands and positioned underneath one or both feet (toes or back of heels). In other exemplary exercises, users may place a hand on one or both of the dome-shaped tops 15 of the stability heads 12, 14 of a single exercise device 10 to perform a full-body extension or other various body movements and stretches.

Figure 4:
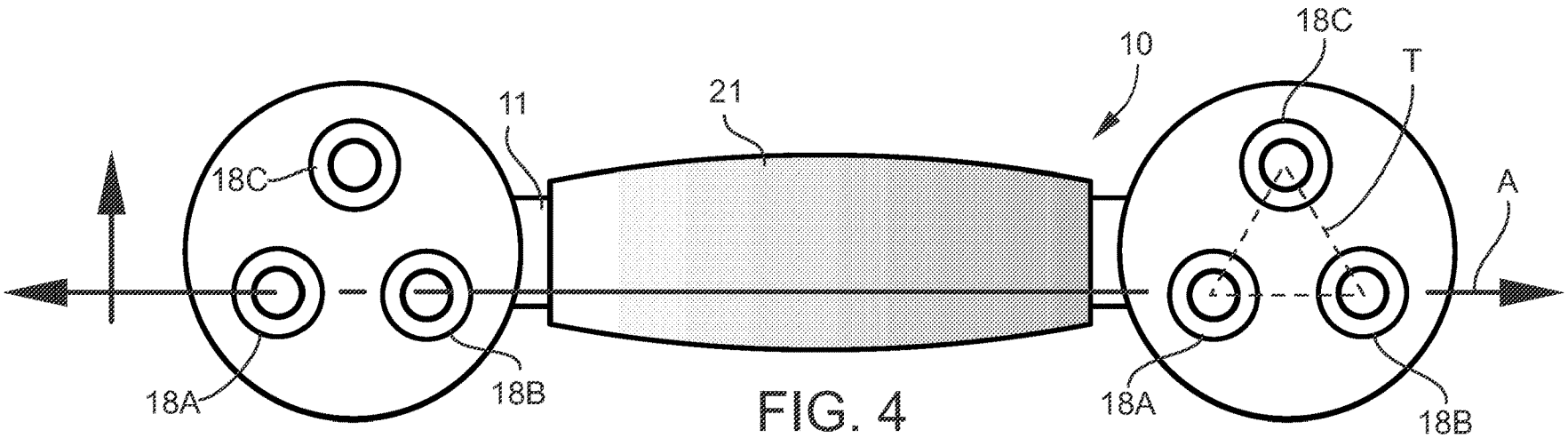
FIG. 4 is a bottom (underside) view of the exemplary exercise device.
Figure 6:
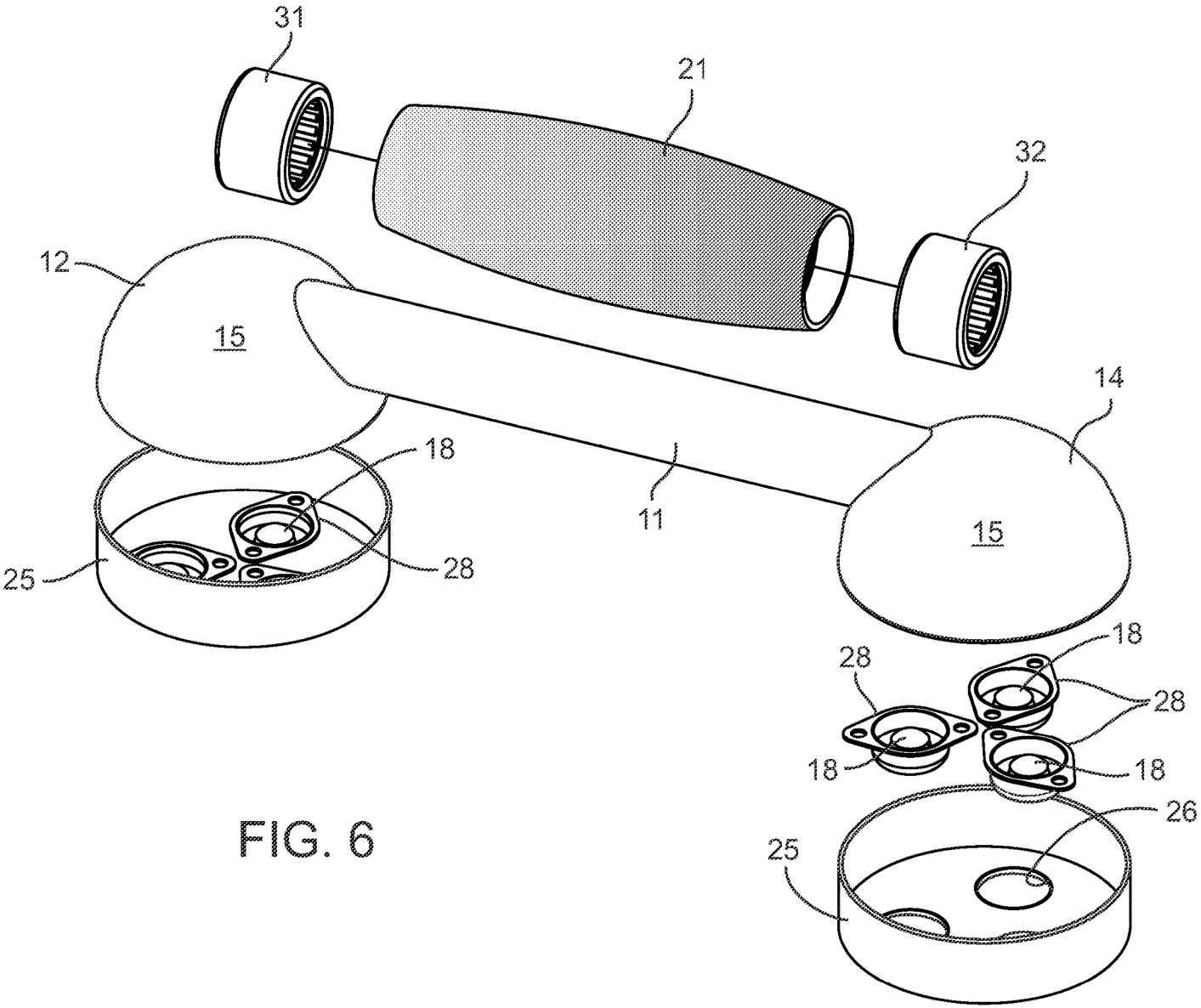
FIG. 6 is an exploded perspective view of the exemplary exercise device.
Figure 7:
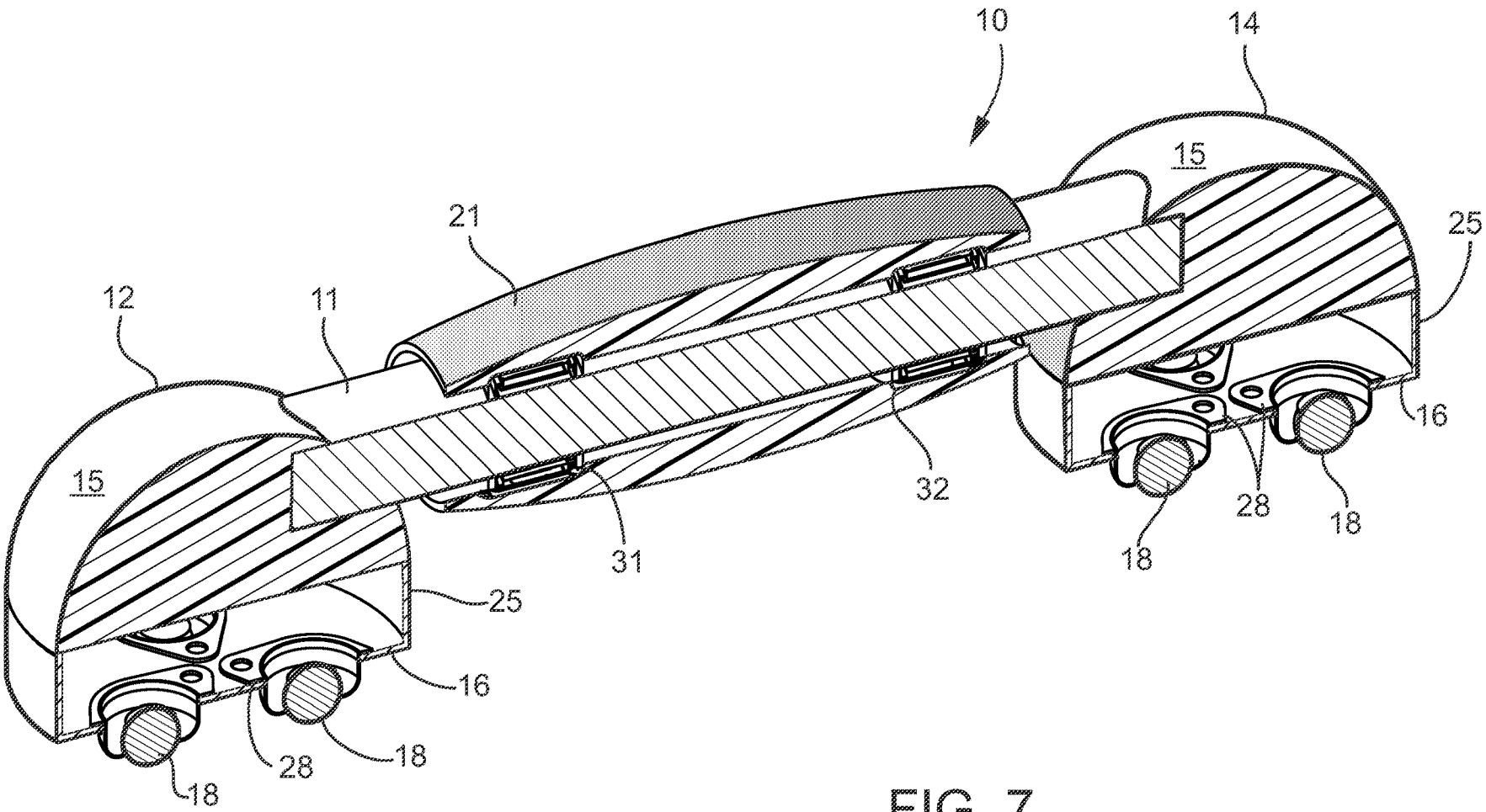
FIG. 7 is a cross-sectional view of the exemplary exercise device taken substantially along line 7-7 of FIG. 4.

Referring to FIGS. 4, 6 and 7, each stability head 12, 14 of the exemplary device 10 further comprises a rigid cylindrical housing 25 integrally formed with the dome-shaped top 15 and defining equally-spaced roller openings 26 in the planar underside 16 of the head 12,14. In the exemplary embodiment, the planar underside 16 is annular and has a diameter of between 10-12 cm. Roller retainers 28 are mounted inside the housing 25 and function to carry and locate the rollers 18 at respective openings 26 formed with the underside 16. The rollers 18 of each stability head 12, 14 are configured to freely roll within the retainers 28 as the exercise device 10 is moved over the floor surface. As best shown in FIG. 4, the arrangement of rollers 18 in each stability head 12, 14 includes first and second inline rollers 18A, 18B substantially aligned with a longitudinal axis "A" of the handle 11, and a third roller 18C laterally offset from the longitudinal axis "A" of the handle 11. In an exemplary embodiment, the first, second and third rollers 18A, 18B, 18C are equally spaced apart from one another and reside at respective points of a notional equilateral triangle "T".

The ergonomic swivel grip 21 of the exemplary exercise device 10 is best shown in FIGS. 6 and 7. The swivel grip 21 is applied to the handle 11 and freely rotates about the longitudinal axis "A" (FIG. 4), such that the swivel motion of the handle 11 when gripped by the user combines with the rollers 18 to increase imbalance in various exercise movements. In the exemplary embodiment, first and second spaced apart needle roller bearings 31, 32 are located between the swivel grip 21 and handle 11. The swivel grip 21 may be fabricated of any suitable material including a durable synthetic rubber (e.g., neoprene) or the like.

Figure 8:
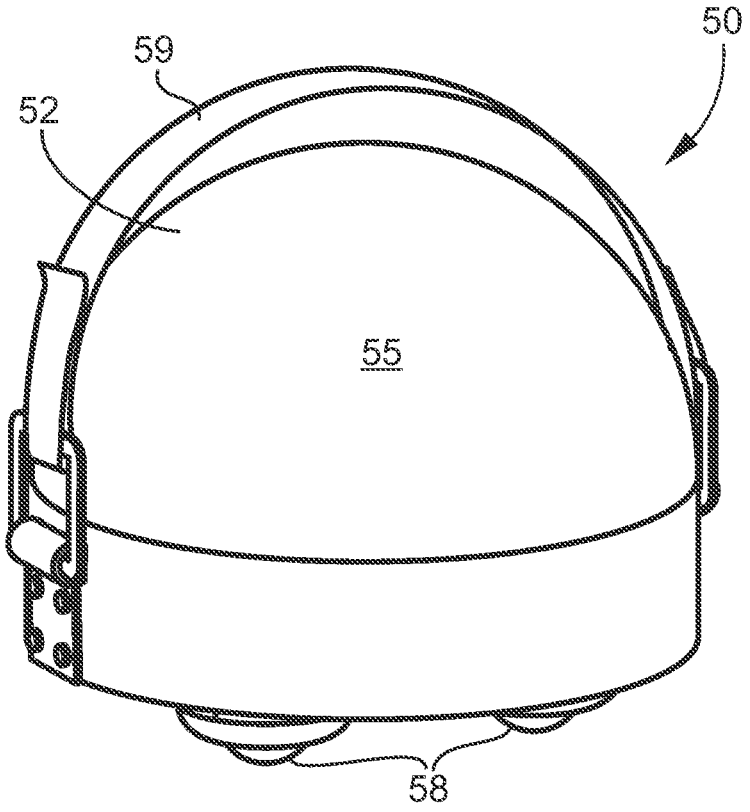
FIGS. 8 and 9 are perspective views of an alternative handheld exercise device of the present disclosure.
Figure 9:
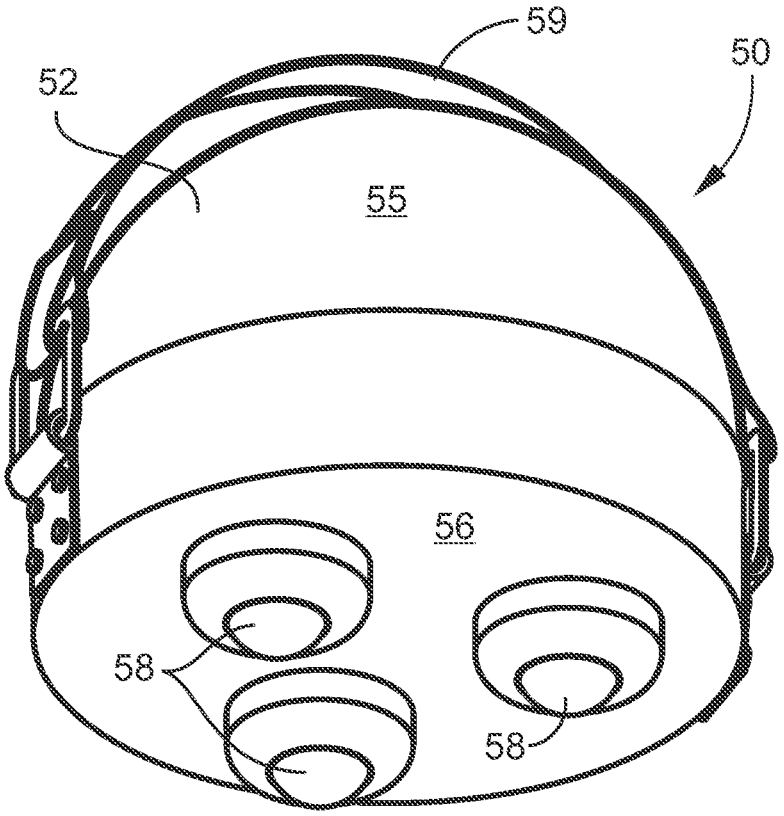
Figure 10:
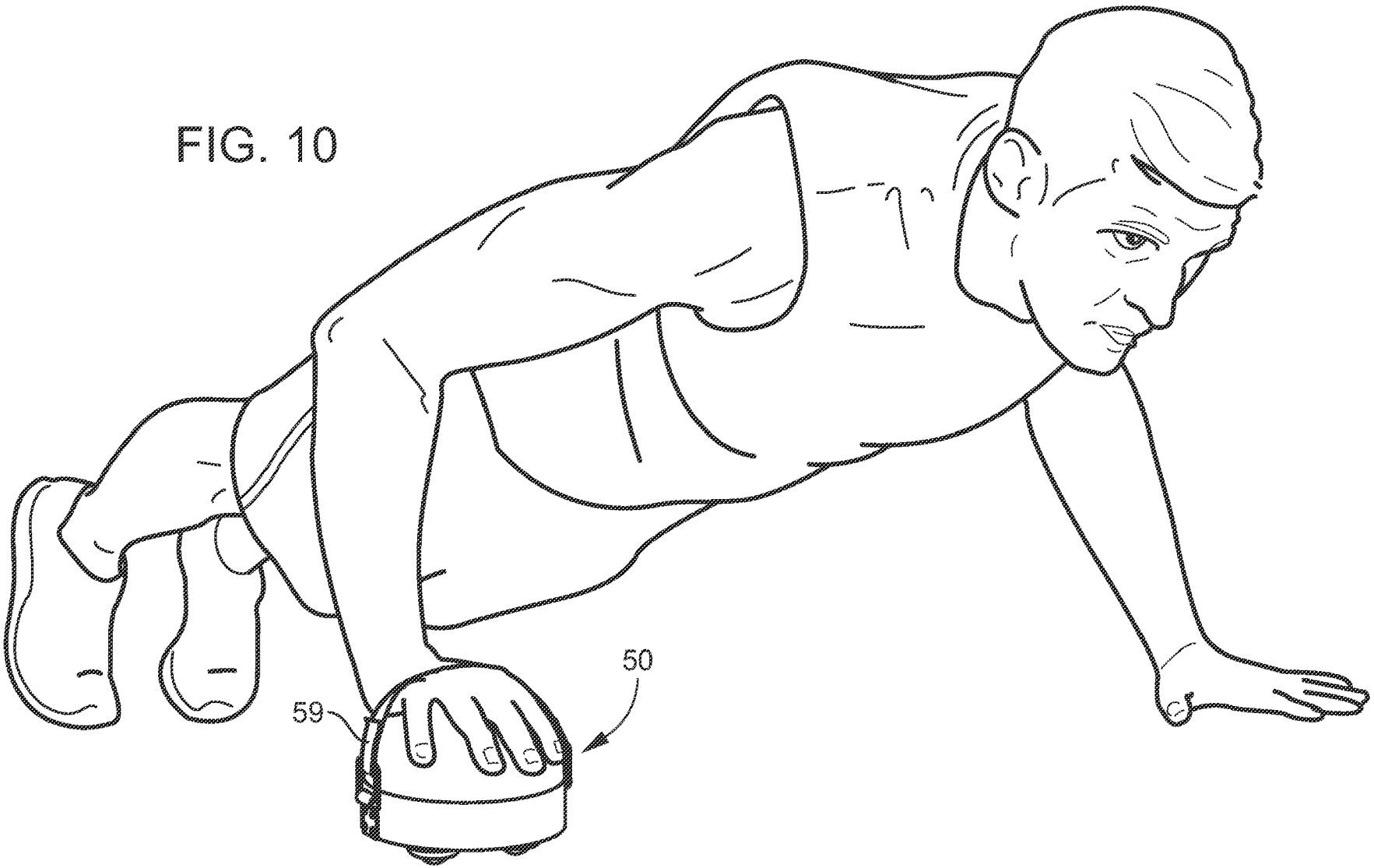
FIG. 10 is a view demonstrating use of the alternative exercise device while performed a floor exercise.

A further exemplary embodiment of the present disclosure is illustrated in FIGS. 8-10. The handheld exercise device 50 comprises a single stability head 52 having a generally dome-shaped top 55 and generally planar underside 56. The dome-shaped top 55 may be fabricated of a molded solid neoprene rubber or other such material, as previously described. An arrangement of surface-engaging rollers 58 projects from the planar underside 56 of the stability head 52 and functions to enable the exercise device 50 to freely roll atop a floor surface. The exemplary rollers 58 may be spaced-apart, housed and retained as previously described. An attached flexible and adjustable strap 59 is applied to the exemplary stability head 52 to releasably secure the exercise device 50 to the hand of the user while exercising—as demonstrated in FIG. 10.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under 35 U.S.C. § 112(f) [or 6th paragraph/pre-AIA] is not intended. Additionally, it is not intended that the scope of patent protection afforded the present invention be defined by reading into any claim a limitation found herein that does not explicitly appear in the claim itself.

What is claimed:

1. A handheld exercise device comprising:

an elongated handle;

first and second stability heads located at opposite ends of said handle, each stability head having a generally dome-shaped top side and generally planar underside, and wherein said handle defines a longitudinal axis extending through said first and second stability heads;

a roller arrangement of surface-engaging rollers projecting from the planar underside of each stability head, and wherein said roller arrangement comprises first and second inline rollers aligned co-linear with the longitudinal axis of said handle and a third roller laterally offset from the longitudinal axis of said handle.

2. The handheld exercise device according to claim 1, and comprising an ergonomic swivel grip applied to said handle and adapted for being gripped by a user.

3. The handheld exercise device according to claim 2, and comprising at least one roller bearing located between said swivel grip and said handle.

4. The handheld exercise device according to claim 3, wherein said roller bearing comprises a needle roller bearing.

5. The handheld exercise device according to claim 4, and comprising first and second spaced apart needle roller bearings located between said swivel grip and said handle.

6. The handheld exercise device according to claim 2, wherein said swivel grip is fabricated of synthetic rubber.

7. The handheld exercise device according to claim 6, wherein said synthetic rubber comprises neoprene.

8. The handheld exercise device according to claim 1, wherein the underside of each stability head is annular.

9. The handheld exercise device according to claim 8, wherein a diameter of the underside of each stability head is between 10-12 cm.

10. The handheld exercise device according to claim 1, wherein said first, second and third rollers are equally spaced apart from one another and reside at respective points of a notional triangle.

11. A handheld exercise device comprising:

an elongated handle;

first and second stability heads located at opposite ends of said handle, each stability head having a generally dome-shaped top side and generally planar underside, and wherein said handle defines a longitudinal axis extending through said first and second stability heads;

a roller arrangement of surface engaging rollers projecting from the planar underside of each stability head, and wherein said arrangement of surface engaging rollers consists of first and second inline rollers aligned co-linear with the longitudinal axis of said handle and a third roller laterally offset from the longitudinal axis of said handle.

12. The handheld exercise device according to claim 11, and comprising an ergonomic swivel grip applied to said handle and adapted for being gripped by a user.

13. The handheld exercise device according to claim 12, and comprising at least one roller bearing located between said swivel grip and said handle.

14. The handheld exercise device according to claim 13, wherein said roller bearing comprises a needle roller bearing.

15. The handheld exercise device according to claim 14, and comprising first and second spaced apart needle roller bearings located between said swivel grip and said handle.

16. The handheld exercise device according to claim 12, wherein said swivel grip is fabricated of synthetic rubber.

17. The handheld exercise device according to claim 16, wherein said synthetic rubber comprises neoprene.

18. The handheld exercise device according to claim 11, wherein the underside of each stability head is annular.

19. The handheld exercise device according to claim 11, wherein said first, second and third rollers are equally spaced apart from one another and reside at respective points of a notional triangle.

* * * * *